United States Patent [19]

Mehrotra

[11] Patent Number: 4,725,351

[45] Date of Patent: Feb. 16, 1988

[54] COLLECTING AGENTS FOR USE IN THE FROTH FLOTATION OF SILICA-CONTAINING ORES

[75] Inventor: Vikram P. Mehrotra, Terre Haute, Ind.

[73] Assignee: International Minerals & Chemical Corp., Terre Haute, Ind.

[21] Appl. No.: 912,940

[22] Filed: Sep. 29, 1986

[51] Int. Cl.[4] ..... B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 1,914,695 | 6/1933 | Lange | 209/166 |
| 2,288,237 | 6/1942 | Green et al. | 209/166 |
| 2,409,665 | 11/1946 | Cole et al. | 209/166 |
| 2,461,817 | 2/1949 | Green et al. | 209/166 |
| 2,629,493 | 2/1953 | Brown | 209/166 |
| 3,462,017 | 8/1969 | Bushell et al. | 209/166 |
| 3,675,773 | 7/1972 | Chemtob et al. | 209/166 |
| 3,844,939 | 10/1974 | Katayanagi | 209/166 |
| 3,914,385 | 10/1975 | Slade | 209/166 |
| 4,206,045 | 6/1980 | Wang et al. | 209/166 |
| 4,276,156 | 6/1981 | Hefner | 209/166 |
| 4,337,149 | 6/1982 | Escalera | 209/166 |

OTHER PUBLICATIONS

McEwen et al., "Single-Stage Flotation of Alkali Feldspars, Ilmenite, Rutile, Garnet, and Monazite, with Mixed Cationic/Anionic Collectors", Society of Mining Engineers, AIME, vol. 260, pp. 97–100 (1976).

Smith, "Effect of Amine Structure in Cationic Flotation of Quartz", Society of Mining Engineers, AIME, vol. 254, pp. 353–357 (1973).

Fuerstenau et al., "The Role of Basic Aqueous Complexes in Anionic Flotation of Quartz", Society of Mining Engineers, AIME, vol. 238, pp. 196–200 (1967).

Clemmer et al., "Beneficiation of Iron Ores by Flotation", Report by the U.S. Department of the Interior, (1945).

*Primary Examiner*—S. Leon Bashore
*Assistant Examiner*—Thomas M. Lithgow
*Attorney, Agent, or Firm*—Wendell Ray Guffey; Thomas L. Farquer; D. Byron Miller

[57] ABSTRACT

A new froth flotation collecting agent and an improved flotation process for beneficiating silica-containing ores, particularly phosphate ores, are provided. In the process, silica particles are selectively separated, by froth flotation, as a froth phase from mineral particles, particularly phosphate particles, remaining in an aqueous concentrate phase in the presence of a silica-activating ion and a mixed collecting agent containing an anionic collector and a cationic collector.

22 Claims, 2 Drawing Figures

COLLECTING AGENTS FOR USE IN THE FROTH FLOTATION OF SILICA-CONTAINING ORES

BACKGROUND OF THE INVENTION

1. Field of the Invention

The present invention relates to the benefication of silica-containing ores by froth flotation and more particularly to a novel combination of collecting agents, and methods of using same. The invention is particularly useful in the front floatation of silica from phosphate ores.

2. Description of the Prior Art

It is common practice in front floatation to utilize a chemical collecting agent which is selectively adsorbed on the surface of particles to be collected in order to enhance the concentration of such particles in one phase (e.g., the froth phase) while leaving remaining particles in the other phase (e.g. an aqueous concentrate phase). For example, phosphate ores have traditionally been beneficated using a two stage flotation process. Prior to flotation, the phosphate ore first is screened to remove coarse phosphate pebbles (usually larger than about 1.5 mm) and then attrition scrubbed and classified to remove fine clay materials (referred to as slimes). A typical prior art two stage flotation process is schematically diagrammed in FIG. 1. In the first flotation stage (so called "rougher flotation") the ore, normally containing 10–30% bone phosphate of lime (BPL), is upgraded to about 40–60% BPL by utilization of crude tall oil carboxylic acid (anionic) collectors, which are typically derived as a by-product from the paper industry, and fuel oil as extender. In the anionic flotation circuit the phosphate value are floated in an alkaline pulp (pH of about 8–9) and collected in the froth phase while the silica remains in the aqueous tail phase and is removed in the underflow. The resulting phosphate concentrate ("Rougher Concentrate") from the anionic floatation circuit typically has an acid insoluble (silica) content ranging from about 8–40%. In order to reduce the insoluble content to about 5% or less, the rougher concentrate is acid scrubbed, typically with sulfuric acid, to desorb the carboxylic acid collectors and again washed to remove slimes, the anionic chemical collector and any frothing agents. The scrubbed and washed rougher concentrate is reslurried and then neutralized to a pH of about 7 using, for example, caustic soda or ammonium hydroxide. The neutralized pulp then is sent to a second (so called "cleaner flotation" floatation stage wherein cationic collectors, generally amines, are used to further upgrade the proportion of BPL. The cationic flotation circuit is referred to as a "reverse flotation" circuit since the desired phosphate values remain in an aqueous concentrate phase while the silica impurities are floated and removed in the froth.

Accordingly, it is known in the phosphate ore benefication art to float phosphate from silica using anionic collectors. It also is known to "reverse float" silica from phosphate using cationic amine collectors at a neutral pH.

It also is well known that silica can be floated with anionic collectors, such as fatty acids or their salts, in the presence of silica-activating metal ions such as $Ca^{+2}$, $Fe^{+3}$, $Mg^{+2}$, etc. at pH values determined by the ionic species.

It further is known that the effectiveness of cationic amine collectors in floating silica is adversely influenced by the presence of metal ions. See for example Cationic Depression of Amine Flotation of Quartz. P. Somasundaran, Trans. SME, Vol. 255, March 1974, pp. 64–68 and Amine Flotation of Quartz in the Presence of inorganic Electrolytes, G. Onoda and D. W. Fuerstenau. 7th Intl. Mineral Processing Congress, Vol. 1, Gordon Breach, N.Y. 1964.

U.S. Pat. No. 3,914,385 to Slade discloses a two-stage floatation process for removing iron from iron-contaminated sand (silica). The two-stage Floatation is used to obtain a glass quality sand substantially free of iron contamination. Iron contaminants discolor glass and ceramic materials made from the sand. Sand is slurried and mixed with an anionic collector and subjected to a first froth flotation stage. In the first stage, the iron contaminant is floated and removed while the sand (i.e. silica) is collected in the underflow. The sand then is reslurried and subjected to the second flotation using a cationic collector. In the second flotation the sand is floated while any remaining iron is removed in the underflow tails.

U.S. Pat. No. 3,844,939 to Katayangi discloses using a cationic amine and an anionic higher aliphatic or aromatic sulfonate, in combination, as a mixed flotation collecting agent to separate feldspar from sand (i.e. silica). The flotation is conducted at an acidic pH obtained by adding sulfuric acid to the ore pulp. In this flotation process, feldspar is collected in the froth phase while sand (i.e silica) remains in the aqueous underflow phase. Similarly, "Single-Stage Flotation of Alkali Feldspar, Ilmenite, Rutile, Garnet, and Monazite, with Mixed Cationic Collectors", by McEwen et al., Transactions, Society of Mining Engineers, March 1976, discloses the use of anionic and cationic collectors, in combination, to float feldspar and other heavy minerals from sand (i.e.silica). Flotation is conducted at an acidic pH obtained by addition of sulfuric acid. Feldspar is collected in the froth phase while the sand (i.e.silica) is collected in the aqueous phase.

U.S. Pat. No. 4,337,149 to Escalera discloses a flotation process for separating phosphate values from phosphate ore. The ore is slurried with an anionic collector and a flotation promoter comprising an amine oxide before feeding to the flotation cell. In the cell, the phosphate particles are collected in the froth phase while the silica is collected in the aqueous underflow (tails) phase.

SUMMARY OF THE INVENTION

The present invention is based upon the unexpected discovery that the anionic flotation of silica in the presence of an activating metal ion is greatly improved by the presence of a small amount of a metal ion is greatly improved by the presence of a small amount of a cationic collector, such as an amine or a quaternary ammonium compound. In the case of a typical two stage phosphate ore froth flotation beneficiation process, the rougher grade is significantly improved to a level where it can be further upgraded in the conventional cleaner circuit.

The present invention provides an improved froth flotation process for selectively separating solid silica particles in a froth phase from other solid mineral particles remaining in the aqueous concentrate phase while in the presence of a silica activating ion and a collecting agent comprising a combination of an anionic collector and a cationic collector. The invention has important applications in the beneficiation of ores which contain silica as a gangue mineral or as a valuable mineral, such as purified silica's used in the production of glass and ceramics. Examples of such ores include phosphate, iron and titanium ores.

One advantage of the present invention is that the presence of the cationic collector lowers the amount of anionic collector, per unit weight of ore fed to the flotation process, required to float the silica. Another advantage is that the presence of the cationic collector in the flotation system dramatically improves the recovery of valuable minerals in flotation process. In the case of phosphate flotation, the grade of the rougher concentrate is greatly improved.

Another significant advantage of this process in the flotation of phosphate ore is that it does not use any fuel oil (collector extender) during rougher flotation and thereby reduces the reagent cost, especially with weathered ores which consume large quantities of fuel oil during rougher flotation. These and other advantages of the process will become readily apparent to those skilled in the art based upon the disclosure contained herein.

DETAILED DESCRIPTION

Figure 1:
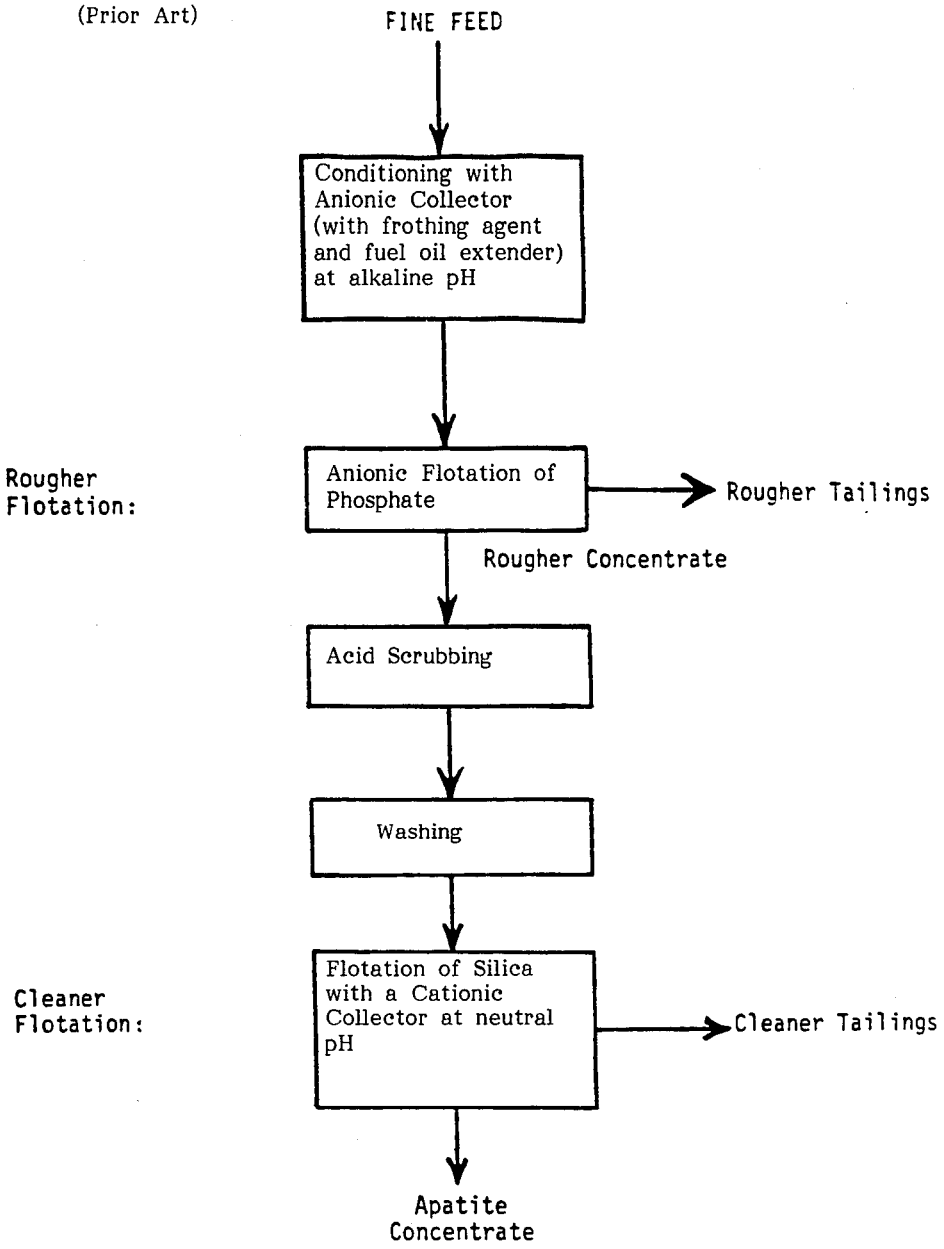
Figure 1 (Prior Art)
FIG. 1 is a schematic process flow diagram of a prior art two-stage froth flotation.
Figure 2:
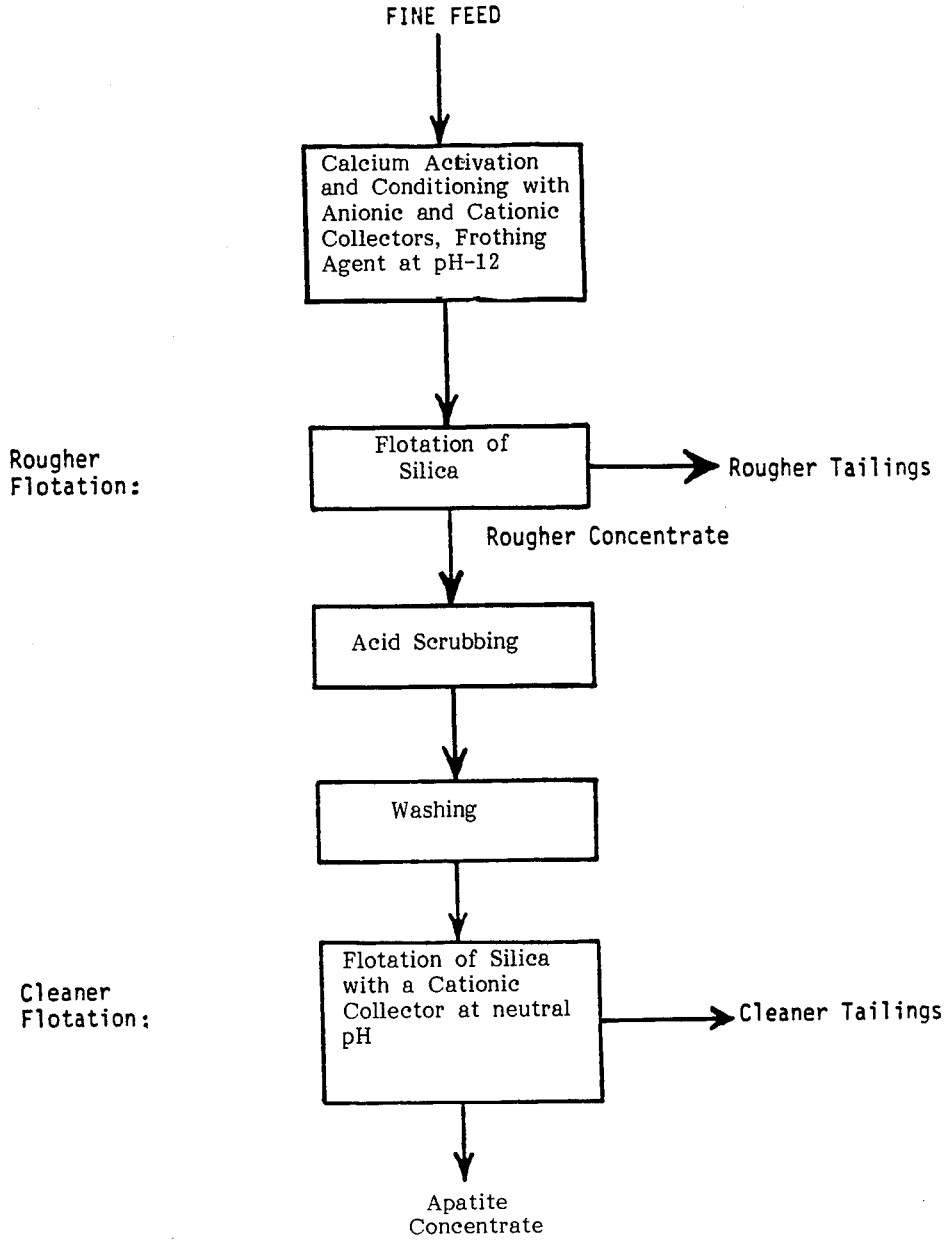
FIG. 2 is a schematic process flow diagram of the present invention which is described in detail in the following description and examples.

Froth flotation is a beneficiation process whereby a communited ore is slurried in an aqueous medium to form a pulp through which a gas, such as air, is sparged. One or more components of the ore is thereby selectively caused to rise to the surface of the slurry in a frothing chamber while the chamber is being sparged with gas. The particles are caught in the froth formed on the surface of the slurry in the chamber and are removed with the froth while particles that do not rise remain in the slurry and are drawn off through the bottom of the flotation chamber. Froth flotation equipment useful in practicing the present invention can be of any conventional design wherein air or other gaseous medium is sparged through a tank containing an aqueous pulp of comminuted ore, frothing agents, collectors and other frothing aids. The selection of the particular equipment forms no part of the present invention and details on the selection thereof can be obtained, for example, from pages 1085–1091 of the Chemical Engineer's Handbook, 3rd edition, McGraw-Hill Book Company (1950), the disclosures of which are incorporated herein by reference.

The present invention concerns a froth flotation process which uses a combination of collectors in the flotation of silica from an aqueous slurry of comminuted ore. Broadly stated, the process comprises activating silica with a silica activating cation such as $Ca^{+2}$ and then using a combination of two components: an anionic collector and a cationic collector.

The anionic collector component of the collecting agent of the present invention may be selected from any of the known anionic collectors conventionally used in anionic froth flotation processes, although specially prepared anionic collectors may also be used as is necessary, desirable or convenient. Conventional anionic collectors include carboxylic acids (fatty acids) including vegetable oil fatty acids, tall oil fatty acids, fatty acids derived from animal fat, marine oils, synthetic carboxylic acids, and combinations of such fatty acids. The fatty acids may be straight or branched chain, saturated or unsaturated. Specific examples of suitable fatty acids which may be used in the practice of the present invention include caprylic, lauric, myristic, palmitic, stearic, oleic, linoleic, linolenic, arachidic, behenic, and like fatty acids. The fatty acids may be used in a purified state or in a crude state as a mixture, e.g. tall oil.

Salts of the above mentioned fatty acids may also be used as the anionic collector component in the practice of the present invention. These salts are normally obtained by the neutralization of the crude fatty acids with sodium hydroxide, potassium hydroxide, ammonia and/or like bases. A particularly preferred anionic collector for the flotation of silica, for example, from phosphate ore, is sodium oleate which is formed by neutralizing oleic acid with NaOH.

Sulfonated hydrocarbons also can be used as the anionic collector component of the collecting agents of the present invention. Suitable sulfonated hydrocarbons include, among others, sulfonated olefins and alkane sulphonates. The sulfonated olefins are generally obtained by the sulphonation of olefins, with sulfur trioxide, preferably alpha-olefins, containing at least five carbon atoms, using techniques well known to those skilled in the art. Hydrocarbon sulfonates also can be prepared by the reaction of unsaturated hydrocarbons with sulphuric acid under mild conditions as is well known to those skilled in the art. Suitable unsaturated hydrocarbon starting materials include unsaturated petroleum fractions, olefins and especially alpha-olefins, and unsaturated fatty acids. Examples of olefins, which may be sulfonated for use as the anionic collector component, include the pentenes, hexenes, heptenes, octenes, nonenes, decenes, undecenes, dodecenes, tridecenes, tetradecenes, pentadecenes, hexadecenes, octadecenes, nondecenes, eicosenes, heneicosenes, doeicosenes, trieicosenes, tetraeicosenes, pentaeicosenes, hexaeicosenes, octaeicosenes and like olefins, as well as mixtures thereof.

Alkane sulfonates are typically obtained by reacting the corresponding olefin with an alkaline bisulphite under free radical conditions as is well known to those skilled in the art. The alkane sulfonates, based on alpha-olefins, may also be prepared by the addition of hydrogen sulfide to an alpha-olefin to give a mercaptan followed by oxidation to the sulfonate; the addition of alpha-olefins to thioacetic acid to give a thioester, which then is oxidized to the sulfonate; and the addition of hydrogen bromide to the alpha-olefin to give an alkyl bromide, which is converted to a sulphate by the addition of sodium sulfite.

The anionic collector component generally is added to the aqueous pulp slurry in an amount of about 0.5 to 3.0 lbs/metric ton of ore, preferably from about 1.0 to 2.0 lbs/ton.

The cationic collector component of the collecting agent of the present invention may be any higher aliphatic amine surfactant known to have utility as a collector in conventional cationic flotation processes. These surfactants often contain at least one amino group and have at least one long chain hydrocarbon group which may be saturated or unsaturated attached to a nitrogen atom. Primary ($H_2NR$), secondary ($RHNR'$) and tertiary ($RR'NR''$) amines wherein R,R' and R'' are all aliphatic hydrocarbon chains containing about 8 to 18 carbon atoms, may be used as the cationic amine component. Quaternary ammonium compounds as well as other known cationic collecting compounds may also be used as the cationic collector.

Examples of suitable amines include higher alkyl amines such as dodecylamine, pentadecylamine and octadecylamine; primary amines including mixed amines such as, for example, coconut oil amines, beef tallow amines and soybean oil amines; secondary amines such as N-dodecylpropylenediamine, N-pentadecylethylenediamine, N-decylhexamethylenediamine and beef tallow propylenediamine: and tertiary amines such as condensates of stearic acid with N-oleyl-N-diethylethylenediamine or triethanolamine and N-acylates of alkylenetriamines, with inorganic acids such as hydrochloric acid and phosphoric acid or with organic acids such as acetic acid, propionic acid, tertaric acid and succinic acid. A particularly preferred amine is sold under the trade name AZ-36A Amine by AZ Products Company, Lakeland, FL.

The cationic collector component is generally added to the pulp in an amount of about 0.05 to 0.5 lbs of amine per metric ton of ore, preferably from about 0.1 to 0.3 lbs/ton and most preferably from about 0.15 to 0.25 lbs/ton.

The weight ratio of the anionic collector to the cationic collector in the mixed collecting agents of the present invention is within the range of about 2 to 10, and preferably within the range of about 4 to 6.

It is necessary in practicing the present invention to add a flotation activator to the pulp which specifically activates the flotation of quartz or silica. Examples of suitable silica activating ions include calcium, magnesium, aluminum and iron but other ions known to be effective in activating the flotation of silica with an anionic collector also can be used. Calcium is an especially preferred silica activating ion since it is normally present in sufficient quantities (i.e. about 10–30 ppm) in municipal water, which is typically used to make the aqueous pulp. The activating ions generally may be added to the pulp in the form of their salts or other compounds, e.g. as a chioride or hydroxide compound, in quantities sufficient to achieve silica activation. For example, in the case of a silica-containing phosphate ore slurry, a calcium concentration of about 10 to 100 ppm is sufficient to achieve silica activation. In such a case, the calcium may be added in the form of CaCl.

It will be appreciated by those skilled in the art that the optimum amounts of anionic collector, cationic collector and silica activating ion present in the pulp will vary depending upon the type of ore and the particular silica activating ion present.

The pH of the pulp should be adjusted to within the range prescribed in published literature for silica activation by a particular type of ionic species. For example, the pH of the pulp should be at least about 12 to 12.5 for silica activation with calcium and at least about 10 to 11 for activation with magnesium. Pulp pH may be adjusted using appropriate amounts of suitable acids or bases as is well known to those skilled in the art.

The following examples demonstrate that the anionic flotation of silica is greatly improved when a cationic amine is added after conditioning the ore with the anionic collector. The addition of amine prior to the anionic collector is also effective and in fact may increase the grade even more than what is obtained by adding the anionic collector first. However, in the case of adding the cationic collector first, the total BPL recovery is adversely affected, even though the grade is improved. Since the total decrease in BPL recovery will vary from feed to feed, it is recommended that tests be done to see whether extra improvement in grade can compensate for the loss in recovery. Although the examples describe the froth flotation of phosphate ores, it is well within the ability of persons skilled in the art to apply the invention to the beneficiation of other ores such as iron and titanium ores. Collector and other reagent levels are given in lbs/metric ton in the examples.

EXAMPLE 1

Rougher flotation tests on deslimed Clear Springs feed were conducted. The particle size of the feed was between 35 and 150 mesh. BPL and insoluble analyses of the feed are included in Table 1. Flotation was carried out in a 250 g Denver flotation cell at a pH of 12.0–12.2 (1 g $Ca(OH)_2$ per 250 g of feed or 8.8 lbs/ton of feed) using an anionic collector (sodium oleate), a cationic amine (AZ-36A) and a frothing asgent (MIBC). Calcium hydroxide was used as a source of Ca ions as well as a reagent to raise the pH to the desired level. The pulp, which contained 20% solids, first was conditioned for 30 seconds with the anionic collector which absorbs on calcium-activated silica and then the pulp was conditioned with the cationic amine for another 30 seconds. These parameters for conditioning the feed were not optimized and those knowledgeable in the art can easily optimize conditioning times. Air was turned on (Denver cell has its own mechanism to draw air at a rate of 4 1/min, and flotation was carried out for 5 minutes, unless it ceased before 5 minutes. Results of the above flotation test are presented in Table 1.

TABLE 1

| | | Frother: MIBC 2 drops | | Ca(OH)2: 8.8 lbs/ton | | | | |
|---|---|---|---|---|---|---|---|---|
| | | Feed Assay | | Product Assay | | | | |
| Anionic Collector Dosage (lb/ton) | Cationic Amine Dosage (lb/ton) | % BPL | % Insol | % BPL | % Insol | % BPL Tailing | % Insol Removed | % BPL Recovery |
| 1.5 | 0.375 | 23.0 | 69.3 | 46.6 | 39.2 | 6.9 | 77.1 | 82.2 |
| 1.5 | 0.25 | 23.2 | 69.2 | 44.5 | 42.4 | 7.4 | 73.9 | 81.8 |
| 1.0 | 0.375 | 22.7 | 70.1 | 41.1 | 47.3 | 4.7 | 66.6 | 89.6 |
| 1.0 | 0.25 | 22.8 | 69.9 | 36.3 | 53.2 | 3.1 | 54.9 | 94.3 |

COMPARATIVE EXAMPLE 1A

Rougher flotation tests were carried out on deslimed Clear Springs fine feed which had a BPL of 22.7% and an acid insoluble content of 70.1%. Particle size of the feed was between 35 and 150 mesh. Flotation was conducted in the same Denver flotation cell used in Example 1. Flotation was conducted using only sodium oleate as the collector. The results of these tests are presented in Table 2.

TABLE 2

| Collector Level (lbs/ton) | $Ca(OH)_2$ g/250 g Feed | $Ca(OH)_2$ lbs/metric ton feed | Feed Assay % BPL | Feed Assay % Insol | Product Assay % BPL | Product Assay % Insol | % BPL in Tailings | % Insol Removed | % BPL Recovery |
|---|---|---|---|---|---|---|---|---|---|
| 1.0 | 1.0 | 8.8 | 22.5 | 70.5 | 27.4 | 64.5 | 1.9 | 26.4 | 98.4 |
| 1.5 | 1.0 | 8.8 | 22.7 | 70.0 | 28.7 | 62.7 | 6.0 | 34.3 | 93.0 |
| 2.0 | 1.0 | 8.8 | 23.1 | 69.4 | 30.1 | 60.7 | 4.9 | 36.7 | 94.2 |
| 3.0 | 1.0 | 8.8 | 22.6 | 70.2 | 32.3 | 58.2 | 6.6 | 48.4 | 88.9 |
| 1.5 | 0.75 | 6.6 | 21.7 | 71.2 | 24.1 | 68.4 | 2.4 | 14.4 | 98.8 |
| 2.0 | 0.75 | 6.6 | 22.8 | 70.1 | 26.9 | 65.2 | 2.4 | 22.8 | 98.2 |
| 3.0 | 0.75 | 6.6 | 22.3 | 82.5 | 31.8 | 79.8 | 2.4 | 34.6 | 96.5 |

EXAMPLE 2

In order to improve the grade of rougher concentrate obtained in the silica flotation process described in Comparative Example 1A, a collecting agent containing an anionic collector component (sodium oleate) and a cationic (AZ-36A) amine component was used. Deslimed Clear Springs Fine Feed with a BPL content of about 15% and an insoluble content of about 78% was first conditioned with the sodium oleate in the presence $Ca^{++}$ ions at a pH of 12. After sodium oleate conditioning, the slurry was further conditioned with a small quantity of the amine prior to flotation. The experimental procedure was the same as that described in Example 1. Table 3 presents a summary of the results. To show the synergistic effect of the combination of the sodium oleate with the amine, data corresponding to zero amine and zero anionic collector additions is also included in this table.

TABLE 3

| Anionic Collector: Sodium Oleate Frother: MIBC 2 Drops | Cationic Amine: AZ-36A $Ca(OH)_2$: 8.8 lbs/ton | | | | | | | |
|---|---|---|---|---|---|---|---|---|
| | | Feed Assay | | Concentrate Assay | | | | |
| Anionic Collector Dosage (lb/ton) | Cationic Collector Dosage (lb/ton) | % BPL | % Insol | % BPL | % Insol | % BPL Tailing | % Insol Removed | % BPL Recovery |
| 1.5 | 0.25 | 15.3 | 78.1 | 44.7 | 36.7 | 5.8 | 88.4 | 71.4 |
| 1.5 | 0.125 | 15.6 | 78.1 | 37.8 | 47.2 | 5.2 | 80.4 | 77.3 |
| 1.0 | 0.25 | 15.0 | 78.6 | 44.4 | 36.7 | 3.7 | 84.0 | 82.1 |
| 1.0 | 0.125 | 15.5 | 78.1 | 35.1 | 51.1 | 3.8 | 75.6 | 84.6 |
| 1.5 | 0 | 15.5 | 78.7 | 32.7 | 56.5 | 2.3 | 68.9 | 91.6 |
| 1.0 | 0 | 15.4 | 78.7 | 27.9 | 62.0 | 3.6 | 61.9 | 87.9 |
| 0 | 0.25 | | | | No flotation of silica | | | |

These results establish that the combined use of the anionic collector and the cationic amine as described results in a higher BPL rougher concentrate at reduced or comparable BPL recoveries, in other words, there is an improved removal of insolubles (silica). It is also clear from these results that the cationic amine, which does not float silica at high pH in the presence of calcium ions, has a synergistic effect when used in combination with an anionic collector such as sodium oleate.

The Examples show that a phosphate rock sample containing 22% BPL and 70% insolubles (mainly silica) can be upgraded to 36.3% BPL and 53% insolubles by using 1 lb of anionic collector (e.g., sodium oleate) per ton of ore and 0.25 lb of AZ-36A amine per ton of ore at 94% BPL recovery. On the other hand, if sodium oleate alone is used, approximately 2 lb/ton dosage is required to achieve 94% recovery with a much lower grade product (30% BPL and 61% insolubles). These tests show that the addition of 0.25 lb of amine per ton in conjunction with sodium oleate increases silica removal from 37% to 55%.

I claim:

1. A silica-containing ore froth flotation beneficiation process which comprises slurrying the ore in water to form an aqueous pulp and sparging a gas through the pulp to selectively separate solid silica particles in a froth phase from solid mineral particles remaining in an aqueous concentrate phase in the presence of an activator and a collecting agent, wherein the activator is a silica-activating ion and the collecting agent is a combination of an anionic collector and a cationic collector.

2. The process of claim 1, wherein the silica activating ion is selected from the group consisting of calcium, magnesium, aluminum and iron.

3. The process of claim 1, wherein the anionic collector is selected from the group consisting of fatty acids, salts of fatty acids and sulfonated hydrocarbons.

4. The process of claim 3, wherein the anionic collector comprises sodium oleate.

5. The process of claim 1, wherein the cationic collector is selected from the group consisting of primary amines, secondary amines, tertiary amines and quarternary ammonium compounds.

6. The process of claim 1, wherein silica activating ion is calcium and the flotation process is carried out at pH greater than about 12.

7. The process of claim 1, wherein the silica activating ion is magnesium and the flotation process is carried out at a pH greater than about 11.

8. The process of claim 1, wherein the ore is phosphate ore and the gas sparged through the pulp to form the froth phase is air.

9. The process of claim 3, wherein the pulp contains about 1.0–1.5 pounds of the anionic collector per metric ton of the ore.

10. The process of claim 5, wherein the pulp contains about 0.1–0.4 pounds of the cationic collector per metric ton of the ore.

11. The process of claim 2, wherein the silica activating ion comprises calcium.

12. The process of claim 10, wherein the pulp contains at least 10 ppm of calcium activating ion.

13. A silica-containing ore froth flotation beneficiation pulp for selectively separating solid silica particles in a froth phase from solid phosphate particles remaining in an aqueous concentrate phase by sparging a gas through the pulp, said pulp comprising an aqueous slurry of the ore and containing a silica activating ion, an anionic collector and a cationic collector.

14. The pulp of claim 13, wherein the weight ratio of the anionic collector to the cationic collector is within the range of about 2 to 15.

15. The pulp of claim 13, wherein the silica activating ion is selected from the group consisting of calcium, magnesium, aluminum and iron.

16. The pulp of claim 15, wherein the anionic collector is selected from the group consisting of fatty acids, salts of fatty acids and sulfonated hydrocarbons.

17. The pulp of claim 16, wherein the anionic collector comprises sodium oleate.

18. The pulp of claim 16, wherein the cationic collector is selected from the group consisting of primary amines, secondary amines, tertiary amines and quarternary ammonium compounds.

19. The pulp of claim 13, wherein the silica activating ion comprises calcium.

20. The pulp of claim 19, wherein the pulp has a pH greater than about 12.

21. The pulp of claim 13, containing about 1.0–1.5 pounds of the anionic collector per metric ton of the ore.

22. The pulp of claim 13, containing about 0.1–0.4 pounds of the cationic collector per metric ton of the ore.

* * * * *

UNITED STATES PATENT AND TRADEMARK OFFICE

CERTIFICATE OF CORRECTION

PATENT NO. : 4,725,351

DATED : February 16, 1988

INVENTOR(S) : Vikram P. Mehrotra

It is certified that error appears in the above-identified patent and that said Letters Patent are hereby corrected as shown below:

Column 1, line 7, "benefication" should read -- beneficiation --
Column 1, line 11, "front floatation" should read -- froth flotation --
Column 1, line 14, "front floatation" should read -- froth flotation --
Column 1, line 21, "beneficated" should read -- beneficiated --
Column 1, line 34, "value" should read -- values --
Column 1, line 38, "floatation" should read -- flotation --
Column 1, line 49, ""cleaner flotation" floatation" should read -- "cleaner flotation") flotation --
Column 1, lines 56 & 57, "benefication" should read -- beneficiation --
Column 2, line 8, "floatation" should read -- flotation --
Column 2, line 9, "Floatation" should read -- Flotation --
Column 2, lines 51 & 52, delete the words -- is greatly improved by the presence of a small amount of a metal ion --
Column 3, line 32, "communited" should read -- comminuted --
Column 5, line 15, "tertaric" should read -- tartaric --
Column 5, line 40, "chioride" should read -- chloride --
Column 6, line 31, "asgent" should read -- agent --
Column 8, Claim 5, line 3, "quarternary" should read -- quaternary --

UNITED STATES PATENT AND TRADEMARK OFFICE

CERTIFICATE OF CORRECTION

PATENT NO. : 4,725,351

DATED : February 16, 1988

INVENTOR(S) : Vikram P. Mehrotra

It is certified that error appears in the above-identified patent and that said Letters Patent is hereby corrected as shown below:

Column 10, Claim 18, line 3, "quarternary" should read
-- quaternary --

Signed and Sealed this

Twenty-third Day of August, 1988

*Attest:*

DONALD J. QUIGG

*Attesting Officer*

*Commissioner of Patents and Trademarks*